US007328803B2

(12) United States Patent
Yamazaki et al.

(10) Patent No.: US 7,328,803 B2
(45) Date of Patent: Feb. 12, 2008

(54) SHOCK PROTECTION PACKAGE AND PACKING METHOD THEREOF

(75) Inventors: Tomoaki Yamazaki, Osaka (JP); Mariko Kitsugi, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 225 days.

(21) Appl. No.: 10/900,364

(22) Filed: Jul. 28, 2004

(65) Prior Publication Data

US 2005/0045523 A1 Mar. 3, 2005

(30) Foreign Application Priority Data

Aug. 29, 2003 (JP) ..... 2003-307828

(51) Int. Cl.
*B65D 81/02* (2006.01)
*B65D 85/38* (2006.01)

(52) U.S. Cl. ..... 206/588; 206/305; 206/583; 206/589

(58) Field of Classification Search ..... 206/521, 206/523, 588, 590, 592, 443, 446, 589, 482–483, 206/305, 320; 220/4.21, 4.22–4.23, 4.24–4.25; D9/737; 229/406
See application file for complete search history.

(56) References Cited

U.S. PATENT DOCUMENTS 973,607 A * 10/1910 Wright ..... 206/446
2,014,091 A * 9/1935 Shepard ..... 217/21
2,908,437 A * 10/1959 Wiedenmeier ..... 206/320
3,243,037 A * 3/1966 Luertzing ..... 206/521
3,429,424 A * 2/1969 Dow ..... 206/590
3,923,152 A * 12/1975 Minneman ..... 206/478
D263,176 S * 3/1982 Harrington ..... D3/285
4,375,262 A * 3/1983 Hrenyo ..... 206/521
4,757,894 A * 7/1988 Schreckenstein ..... 206/589
5,127,526 A * 7/1992 Vigue ..... 206/523
5,779,055 A * 7/1998 Lacy, III ..... 206/521
5,871,097 A * 2/1999 Shida et al. ..... 206/521
6,321,911 B1 * 11/2001 Raimer et al. ..... 206/521

FOREIGN PATENT DOCUMENTS

JP 58-88358 U 6/1983
JP 58-192258 U 12/1983
JP 63-158868 U 10/1988
JP 6-298288 A 10/1994
JP 2002-302192 A 10/2002

* cited by examiner

*Primary Examiner*—Bryon P. Gehman
(74) *Attorney, Agent, or Firm*—Birch, Stewart, Kolasch & Birch, LLP

(57) ABSTRACT

A package includes a recessed bottom tray having bottom recessed-portions which conform to a shape of a bottom portion of an article, a recessed top cover having top recessed-portions which conform to a shape of an upper portion of the article, and a retainer section, formed in each of the bottom recessed-portions, for retaining the retainer projection formed on the article, so as to prevent movement of the article. This prevents the article from moving in the direction of height, depth, or width, and there accordingly will be no falling of the article. Further, packing merely requires that the article be inserted into the bottom recessed-portion by straddling the retainer sections formed in the bottom recessed-portion, and that the recessed top cover be placed from above. Thus, there is provided a package that allows for easy packing and that can prevent the article from being damaged during transport or storage.

31 Claims, 22 Drawing Sheets

SHOCK PROTECTION PACKAGE AND PACKING METHOD THEREOF

This Nonprovisional application claims priority under 35 U.S.C. § 119(a) on Patent Application No. 2003/307828 filed in Japan on Aug. 29, 2003, the entire contents of which are hereby incorporated by reference.

FIELD OF THE INVENTION

This invention relates to a package for packing articles such as an electronic component, and a method for packing such articles. The invention is useful in packing electrical components such as an electric tuner, or mechanical components such as a gear mechanism. The invention is also useful in the transport or storage of such articles.

BACKGROUND OF THE INVENTION

Conventionally, a package such as a compartmentalized package 100 shown in FIG. 13 has been used to anchor a plurality of articles H such as electronic components. The package 100 has lateral partitions 101, and longitudinal partitions 102 intersecting the lateral partitions 101. The lateral partitions 101 and the longitudinal partitions 102 form a plurality of storage compartments in a matrix manner.

The package 100 stores the article H by, for example, holding it on a pedestal section 101*b* that is formed by folding back the lateral partition 101, as shown in FIGS. 14(*a*) and 14(*b*).

In the production of the package 100, first, a plurality of insertion slots are formed on the upper side of a rectangular card board, corresponding to a longitudinal side of the article H, as shown in FIG. 15, and the bottom side of the card board is cut into a trapezoidal pattern to provide the pedestal section 101*b*. Then, the card board is folded up along a folding line 101*a* as shown in FIG. 16.

Next, two longitudinal partitions 102*a* and 102*b*, made out of a rectangular card board into a comb-shape as shown in FIGS. 17(*a*) and 17(*b*), are laminated as shown in FIG. 18 and FIG. 19(*a*) to make the longitudinal partition 102. The teeth of the longitudinal partition 102 are then inserted into the insertion slots of the lateral partitions 101 as shown in FIG. 19(*b*). Repeating this procedure completes the package 100 as shown in FIG. 13. This type of package 100 is disclosed, for example, in Japanese unexamined patent application No. 06-298288/1994 (Tokukai 6-298288; published on Oct. 25, 1994) and Japanese unexamined patent application No. 2002-302192 (Tokukai 2002-302192; published on Oct. 15, 2002).

Another type of package known as a book-type package is a package 120 as shown in FIG. 20. The package 120 has a recess, corresponding in shape to the article H, in which the article H is placed.

In the production of the package 120, first, a cut-out section 122 that corresponds to the shape of the article H is formed on a board 121 (a single piece of card board), as shown in FIG. 21. Next, as shown in FIG. 22, a peak fold is made on the board 121 along a mountain fold line 123 creased at approximately a ⅓position in the longitudinal direction of the board 121. Then, an adhesive is applied to a paste area on a base plate section 121*a* of the board 121, so as to bond and hold the base plate section 121*a* on the board 121.

Then, a top cover section 121*b* is formed by folding the board 121 along fold lines 124 and 125 as shown in FIG. 22, and the article H is placed in the recess defined by the cut-out section 122. Finally, the package is closed by taping two top edges 126 with a tape 127, as shown in FIG. 23. This type of packages is disclosed, for example, in Japanese utility model publication No. 158868/1988 (Jitsukai 63-158868; published on Oct. 18, 1988) and Japanese utility model publication No. 192258/1983 (Jitsukai 58-192258; published on Dec. 21, 1983)

Another example of a package is a frame-type package in which the article is anchored on a frame.

In this type of package, as shown in FIG. 24, projections 110*a* and 110*b* projecting downward from the both ends of the article H are inserted into slots 131 respectively provided along the top edge of a pair of rail-like frames 131. In this way, the article H is held and anchored on the pair of rail-like frames 131, as shown in FIG. 25. This procedure is repeated until a specified number of articles H are disposed along the frames (not shown).

Next, the respective ends of the pair of rail-like frames 131 are held and anchored on anchors 132. A support 133 holds and anchors the articles H from the top. Package units so prepared may be connected to one another on linkage grooves as shown in FIG. 26, and may be are arranged side by side as shown in FIG. 27.

In the structure of the package 100 shown in FIG. 13, the article H in the vicinity of terminal pins 111 is placed on the pedestal section 101*b*. This may cause the articles H to oscillate when external force is applied, damaging the articles H as a result.

Another drawback is that the terminal pins 111 of the article H may be deformed by interference with the folded part of the lateral partition 101, preventing the article H from forming desirable contacts with external equipment.

As for the package 120 shown in FIG. 20, there is a problem that the package needs to be newly designed every time there is a modification in the shape (dimensions) of the article H. Moreover, large variations in the package cause difficulties in the management, which is problematic in terms of cost, storage space, and productivity. Further, the recess portions that covers the articles according to their shapes must be formed for the number of article produced. This leads to a complex production process and high cost.

The package 130 shown in FIG. 27, with its rail-like frames 131, anchors 132, and support 133, requires an assembling process as shown in FIG. 25. This is problematic in terms of workability and a high cost associated with it.

SUMMARY OF THE INVENTION

In view of the foregoing problems, an object of the present invention is to provide a package and a packing method that allows for easy packing and that can prevent the article from being damaged during transport or storage of the article.

In order to achieve the foregoing object, a package according to the present invention includes a recessed bottom tray having a bottom recessed-portion which conforms to a shape of a bottom portion of an article;

a recessed top cover having a top recessed-portion which conforms to a shape of an upper portion of the article; and a retainer section, formed in the bottom recessed-portion of the recessed bottom tray, for retaining a projection formed on the article, so as to prevent movement of the article.

Further, in order to achieve the foregoing object, a packing method according to the present invention includes the step of supporting and anchoring an article, using: a recessed bottom tray having a bottom recessed-portion which conforms to a shape of a bottom portion of the article;

a recessed top cover having a top recessed-portion which conforms to a shape of an upper portion of the article; and a retainer section, formed in the bottom recessed-portion of the recessed bottom tray, for retaining a retainer projection formed on the article, so as to prevent movement of the article.

The retainer section of the package prevents lengthwise and downward movement of the articles, and the bottom recessed-portion of the recessed bottom tray and the top recessed-portion of the recessed top cover prevents lateral and upward movement of the article. This prevents the article from moving in the direction of height, depth, or width, and there accordingly will be no falling of the article. As for packing, it merely requires that the article be inserted into the bottom recessed-portion by straddling the retainer sections formed in the bottom recessed-portion, and that the recessed top cover be placed from above.

Thus, there is provided a package and a packing method that allows for easy packing and that can prevent the articles from being damaged during transport or storage.

Additionally, to achieve the foregoing object, a package according to the present invention includes a recessed bottom tray having a plurality of bottom recessed-portions which conform to a shape of a bottom portion of an article;

a recessed top cover having a plurality of top recessed-portions which conform to a shape of an upper portion of the article Therefore, in addition to the foregoing effects of the invention, the number of articles that can be packed in a single package can be increased.

Additional objects, features, and strengths of the present invention will be made clear by the description below. Further, the advantages of the present invention will be evident from the following explanation in reference to the drawings.

DESCRIPTION OF THE EMBODIMENTS

One embodiment in accordance with the present invention is described below with reference to FIGS. 1 to 12. Note that a package of this embodiment is to reliably pack an electronic component such as an electronic tuner, or a mechanical component such as a gear mechanism. Further, as the term is used herein, "packing" refers to anchoring a product so as to prevent damage due to oscillation or impact caused by external force during transport or storage of the product.

Figure 2:
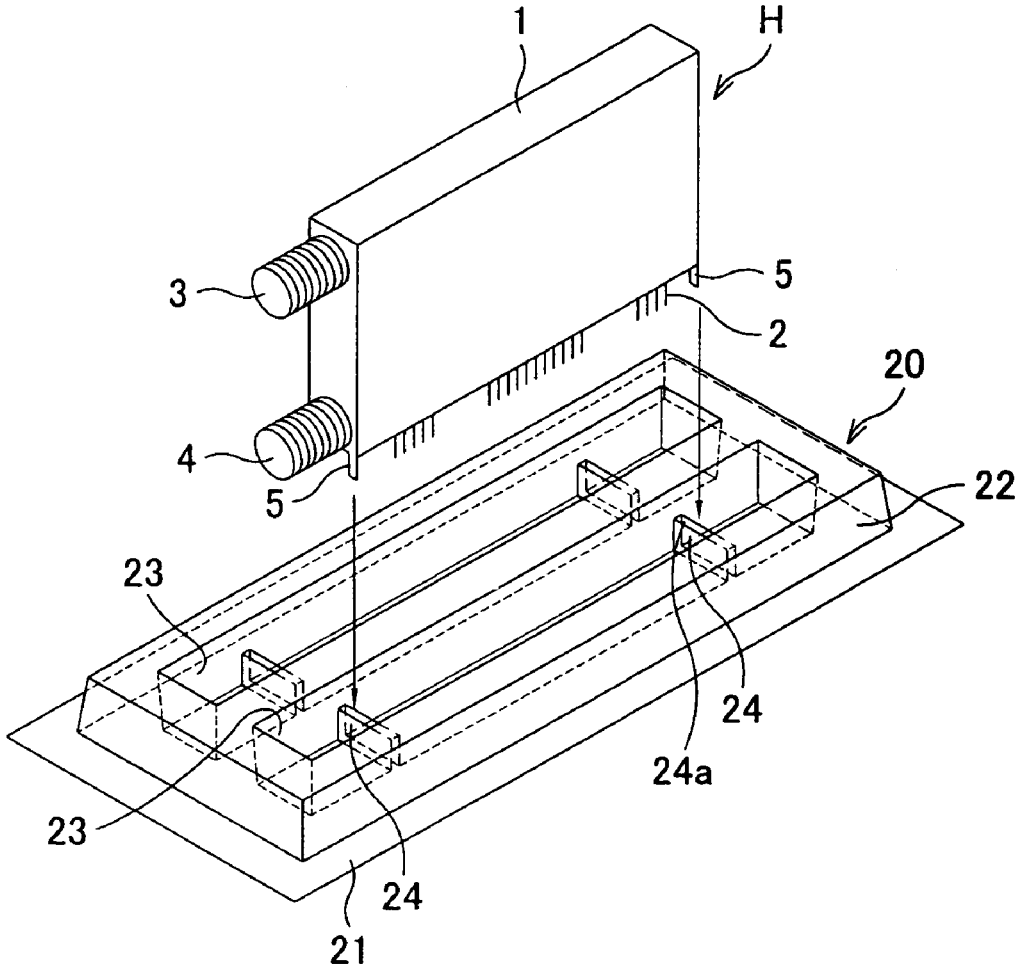
FIG. 2 is a perspective view showing how an article is stored in a bottom recessed-portion of the package.

The package of the present embodiment packs an article H, which may be an electrical component such as an electric tuner (product), for example. As shown in FIG. 2, the article H includes, for example, a tuner main body 1, which is substantially rectangular in shape, and a plurality of terminal pins 2 projecting out of a bottom of the tuner main body 1. The terminal pins 2 may also be lead pins. The tuner main body 1 has cylindrical projections, an input antenna 3 and an output antenna 4, on one end of the longitudinal side.

Further, the tuner main body 1 has chassis pins 5 as projections, projecting downward from the bottom of the tuner main body 1 on the both ends of the longitudinal side. The chassis pins 5 are metal plates or the like, and are provided, for example, to mount the tuner main body 1 on a substrate (not shown) by soldering.

Figure 1:
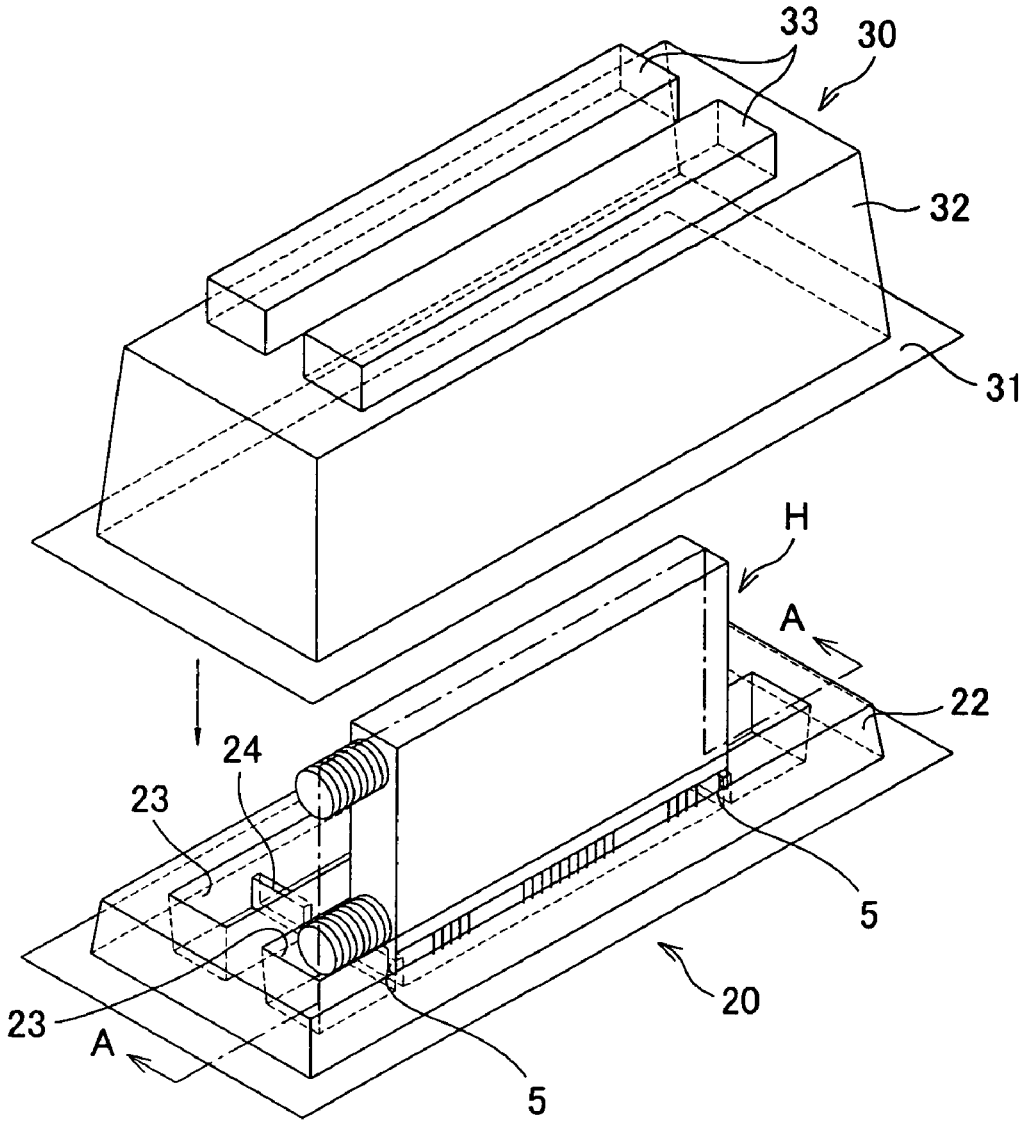
FIG. 1 is an exploded perspective view showing a configuration of a package in accordance with one embodiment of the present invention.

In this embodiment, a package 10 for storing such article H includes a recessed bottom tray 20 and a recessed top cover 30 paired with the recessed bottom tray 20, as shown in FIG. 1. The recessed bottom tray 20 and the recessed top cover 30 are separately prepared from a single elastic plate of plastic resin, for example, by vacuum molding, injection molding, and compression molding. Note that it is preferable that the recessed top cover 30 be transparent, so that the packed article H can be seen.

As shown in FIG. 2, the recessed bottom tray 20 has a peripheral tray edge 21, a trapezoidal tray plateau 22 standing from the inner periphery of the peripheral tray edge 21, and bottom recessed-portions 23 formed side by side in the trapezoidal tray plateau 22. The bottom recessed-portions 23 are rectangular recesses that conform to the shape on the bottom of the articles H, supporting the sides on the bottom face of the articles H. Note that the bottom recessed-portions 23, which are formed side by side in the present embodiment, are not limited to such configuration, and may be formed singly. Moreover, the bottom recessed-portions 23, which are rectangular in shape conforming to the bottom shape of the article H, are not limited to such configuration, and may have some irregularities as long as it conforms to the bottom shape of the articles H. Further, the trapezoidal tray plateau 22, which is trapezoidal in shape in the present embodiment, is not limited to such shape and may be rectangular for example. In this case, a trapezoidal cover plateau 32 described later will also be rectangular so as to abut on the rectangular shape of the trapezoidal tray plateau 22.

The longitudinal sides of the bottom recessed-portions 23 have a length substantially equal to the sum length of the tuner main body 1 and the output antenna 4.

Figure 4:
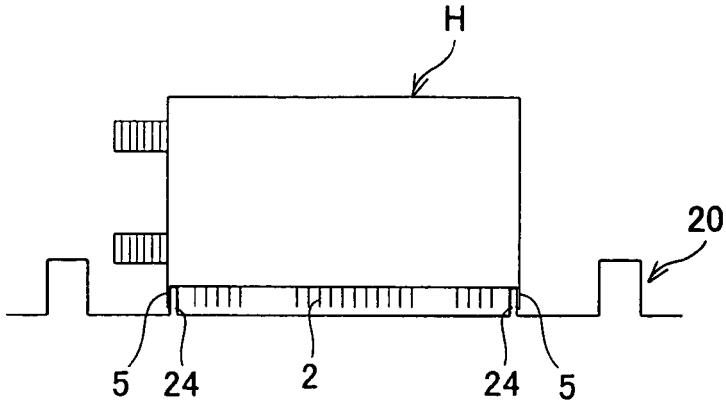
FIG. 4 is a cross sectional view taken along the A-A in FIG. 1.

Inside each bottom recessed-portion 23 are provided two retainer sections 24. The retainer sections 24 retain the chassis pins 5 of the article H, thereby preventing the tuner main body 1 in the package from moving. Namely, as shown in FIG. 4, the retainer sections 24 are provided at two separate locations such that the retainer sections 24 are in contact with the inner side of the chassis pins 5 projecting from the bottom on the both ends of the tuner main body 1 in the longitudinal direction. In this way, movement of the tuner main body 1 is prevented.

The retainer sections 24 are made of elastic material, so as to absorb a force of impact exerted on the article H contained in the package. In short, the retainer sections 24 are vertical plates standing on the bottom of each bottom recessed-portion 23. The recessed bottom portion 20 is made of elastic plastic resin, and accordingly the retainer sections 24 formed in one piece with the recessed bottom tray 20 are also made of the same elastic plastic resin. In this way, when in contact with the chassis pins 5, the retainer sections 24 serve as an elastic member against lateral oscillation of the article H, thereby preventing damages to the article H caused by a force of lateral impact.

A top portion 24*a* of each retainer section 24 is flat and straight, enabling the top portion 24*a* to serve as a pedestal section that can stably mount the article H. The height of the retainer section 24 to its top portion 24*a* is set so that the top portion 24*a* is below a top surface of the trapezoidal tray plateau 22, and that the chassis pins 5 or the terminal pins 2 do not interfere with the bottom of the bottom recessed-portions 23 upon placing the article H on the top portion 24*a*.

Figure 5:
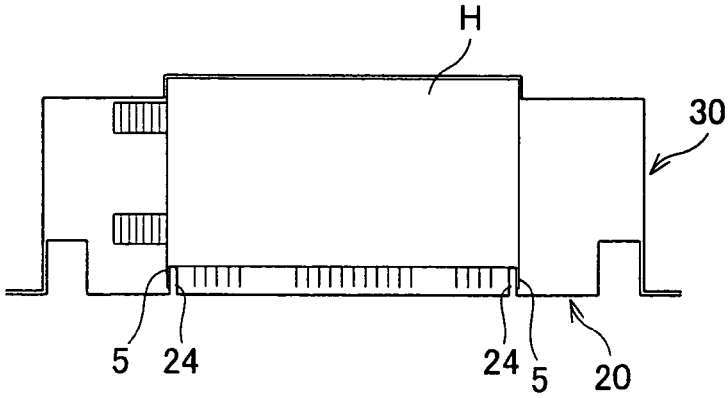
FIG. 5 is a cross sectional view taken along the line B-B in FIG. 3.

As to the recessed top cover 30 as shown in FIG. 1, it includes a peripheral cover edge 31, the trapezoidal cover plateau 32 standing from the inner periphery of the peripheral cover edge 31, and top recessed-portions 33 formed side by side in the trapezoidal cover plateau 32. The peripheral cover edge 31 is sized to match the peripheral tray edge 21. The trapezoidal cover plateau 32 is sized so that its side walls abut the side walls of the trapezoidal tray plateau 22. The top recessed-portions 33 are, for example, rectangular recesses that conform to the shape along the upper portion of the article H, supporting the top portion of the article H on the sides. Note that the top recessed-portions 33, which are formed side by side in this embodiment, are not limited to such configuration, and may be formed singly. Moreover, the top recessed-portions 33, which are rectangular in shape conforming to the upper portion of the tuner main body 1, are not limited to such shape, and may have some irregularities, as shown in FIG. 5, as long as it conforms to the upper portion of the article H.

Figure 6:
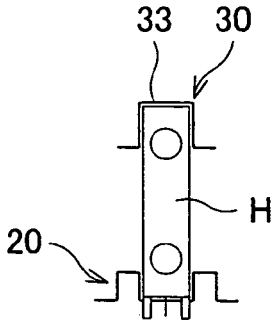
FIG. 6 is a longitudinal sectional view of FIG. 3.
Figure 7:
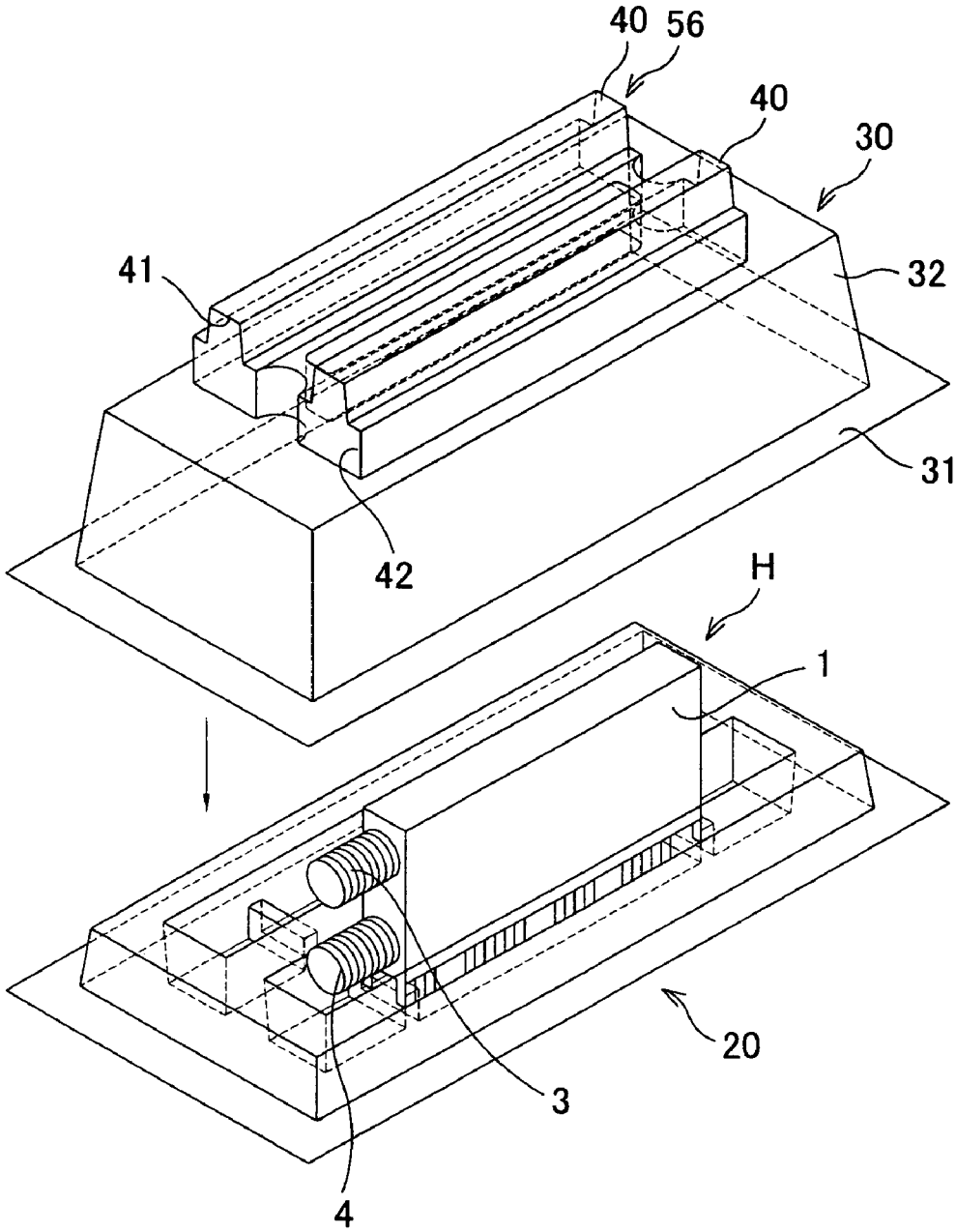
FIG. 7 is an exploded perspective view of a package, showing an upper recessed cover section whose top recessed-portions are formed in a stair manner.
Figure 8:
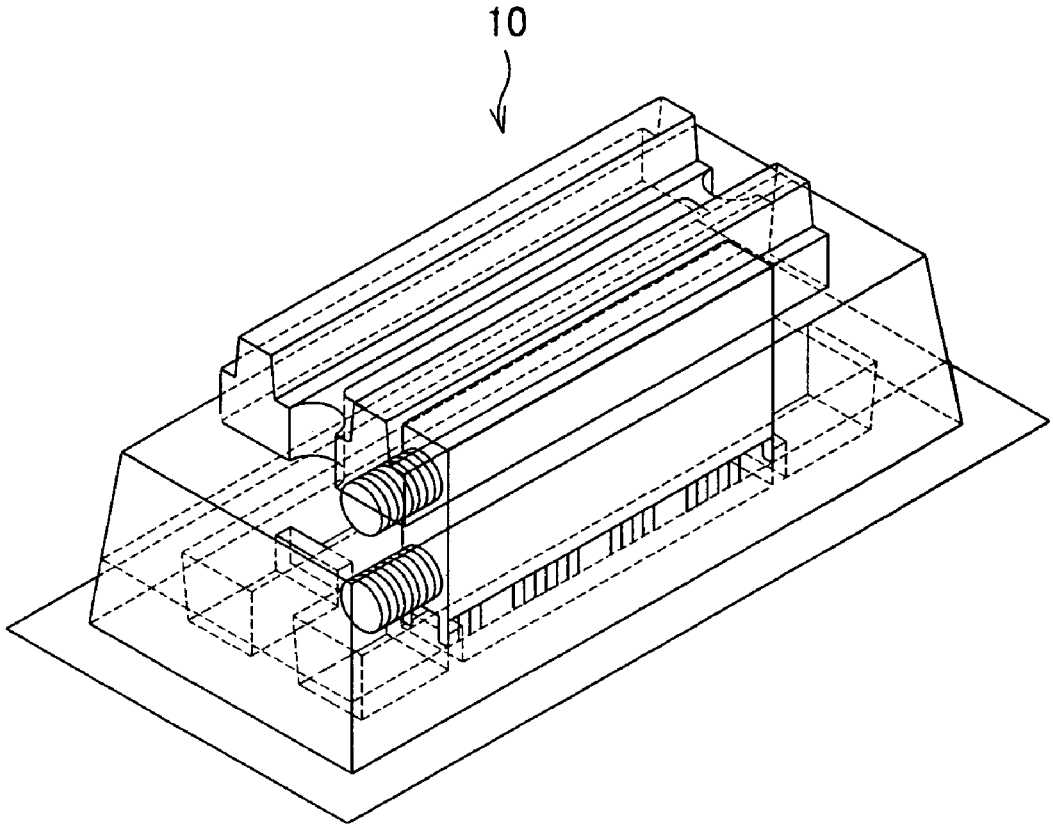
FIG. 8 is a perspective view showing the package storing an article.

As shown in FIG. 6, the longitudinal sides of the top recessed-portions 33 have a length substantially equal to the sum length of the tuner main body 1 and the input antenna 3.

The depth of each top recessed-portion 33 to its bottom is set such that the top surface of the tuner main body 1 contacts the bottom of the top recessed-portion 33 when the article H is placed on the top portions 24*a* of the retainer sections 24 provided in the recessed bottom tray 20.

The following describes a packing method of packing the article H in the package 10.

Figure 3:
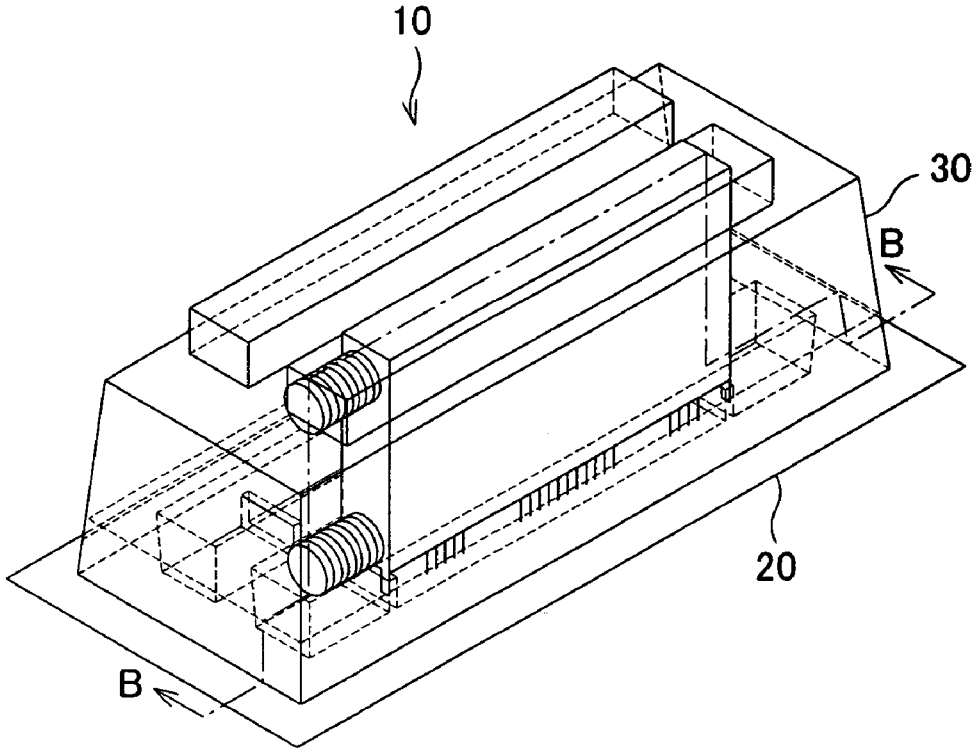
FIG. 3 is a perspective view showing the article stored in the package.

In order to pack the articles H, the present embodiment supports and anchors the articles H with (i) the recessed bottom tray 20 including the bottom recessed-portions 23 that conform to the shape on the bottom portion of the articles H, (ii) the recessed top cover 30 including the top recessed-portions 33 that conform to the shape on the upper portion of the articles H, and (iii) the retainer sections 24 provided in the bottom recessed-portions 23 of the recessed bottom tray 20 for the purpose of retaining the chassis pins 5 of the articles H and thereby preventing movement of the articles H, as shown in FIG. 3.

More specifically, as shown in FIG. 2, the article H is inserted into the bottom recessed-portion 23 such that the retainer sections 24 formed in the bottom recessed-portion 23 of the recessed bottom tray 20 are on the inner side of the chassis pins 5. In this way, the bottom surface of the tuner main body 1 is brought into contact with the top portions 24*a* of the retainers 24, thereby placing the article H on the top portions 24*a* of the retaining sections 24. Further, the bottom portion of the tuner main body 1 are supported on the side walls of the bottom recessed-portion 23.

Next, the recessed top cover 30 is placed from above as shown in FIG. 1. As a result, the top portion of the tuner main body 1 and the top portion of the input antenna 3 are substantially fitted with the top recessed-portion 33, thereby supporting the tuner main body 1 with the top recessed-portion 33.

As a result, the tuner main body 1 is prevented from moving in the longitudinal direction by the retainer sections 24, from moving sideways by the top recessed-portion 33 and the bottom recessed-portion 23, and from moving in a vertical direction by the top recessed-portion 33. Thus, the tuner main body 1 is firmly anchored in the package 10. Packing is therefore made easy because it merely requires that the chassis pins 5 of the tuner main body 1 be inserted in the bottom recessed-portion 23 by straddling the retaining sections 24 of the bottom recessed-portion 23, and that the recessed top cover 30 be placed from above.

Note that, the recessed bottom tray 20 and the recessed top cover 30 may be held together, for example, by taping the respective edges of the peripheral tray edge 21 and the peripheral cover edge 31. Alternatively, the recessed bottom tray 20 and the recessed top cover 30 may be held together more easily by fitting interfitting grooves respectively provided on the peripheral tray edge 21 and the peripheral cover edge 31. This method is disclosed, for example, in Japanese utility model publication No. 88358/1983 (Jitsukai 58-88358; published on Jun. 15, 1983).

Figure 9:
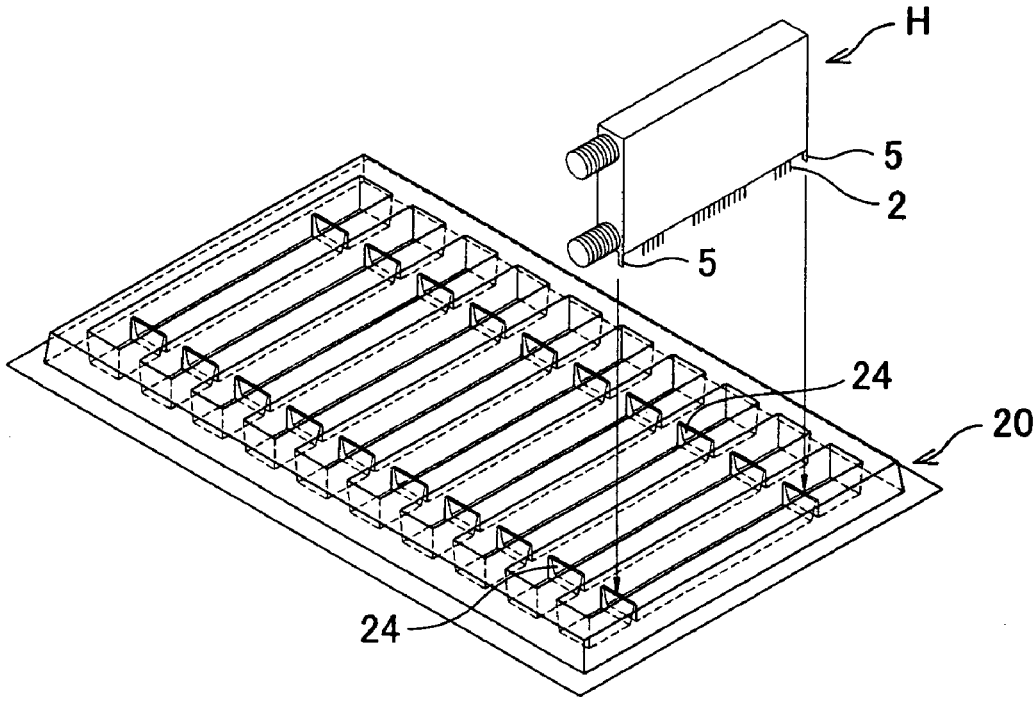
FIG. 9 is a perspective view showing a recessed bottom tray having ten bottom recessed-portions.
Figure 10:
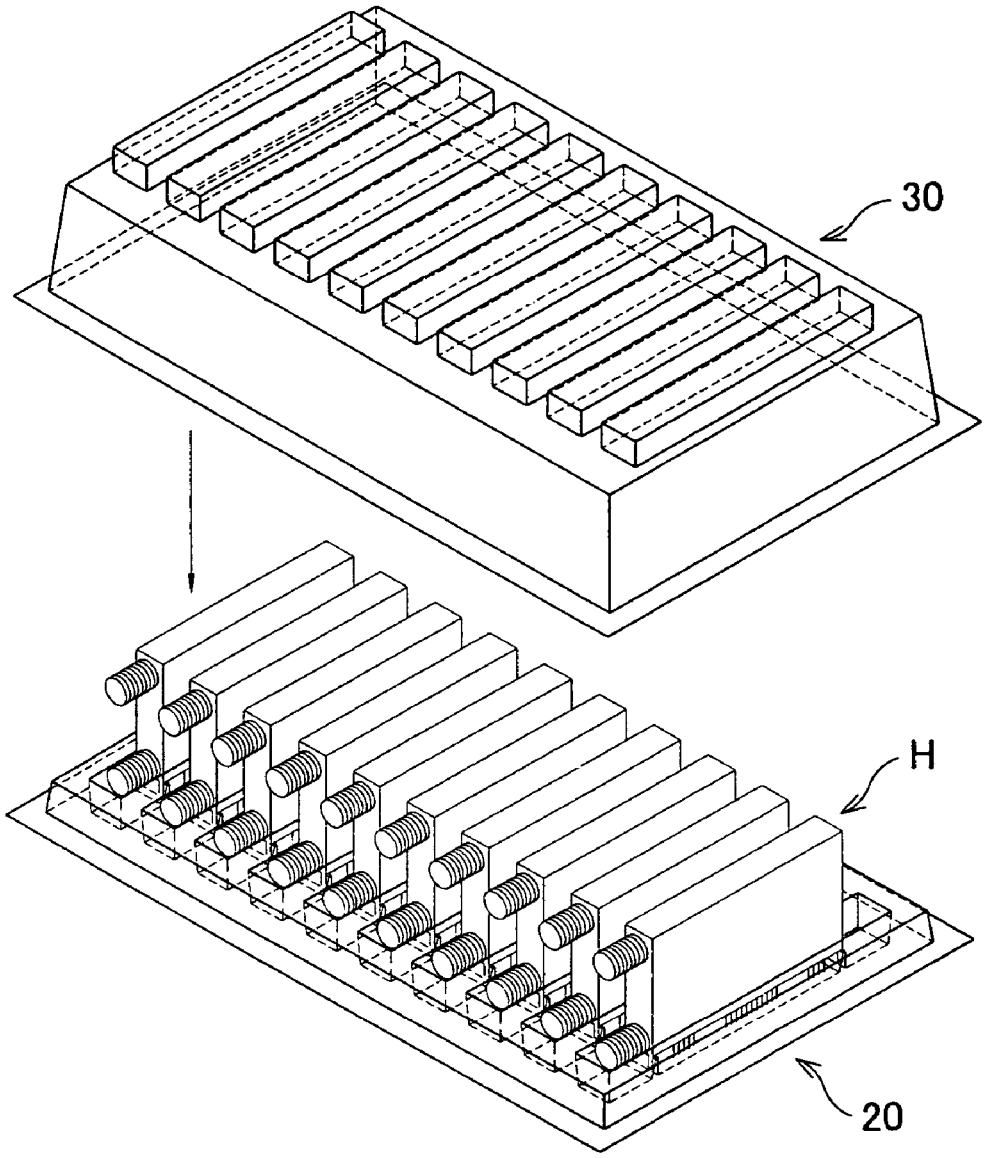
FIG. 10 is an exploded perspective view showing how articles are packed in the recessed bottom tray.
Figure 11:
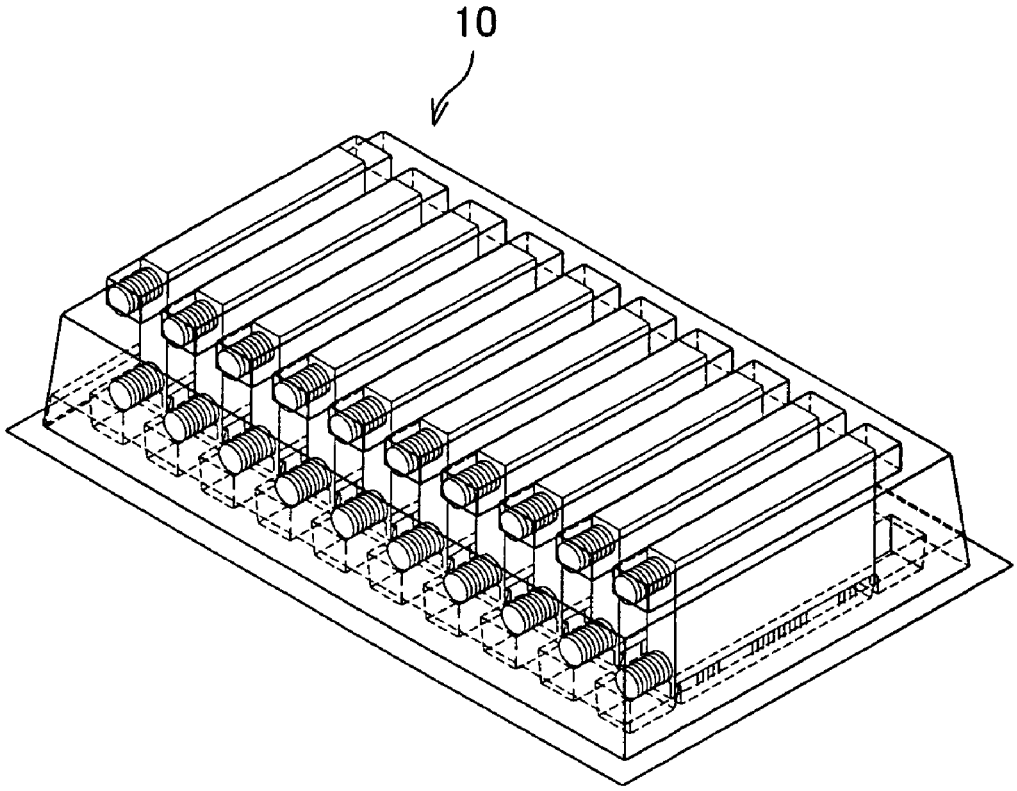
FIG. 11 is a perspective view showing the package storing articles.

Note that, as described in this embodiment, the bottom recessed-portions 23 of the recessed bottom tray 20 are provided either singly or in pairs. This is also the case for the top recessed-portions 33 corresponding to the bottom recessed-portions 23. However, the arrangement is not limited to such arrangements. For example, the bottom recessed-portions 23 or the top recessed-portions 33 may be provided side by side in groups of ten, as shown in FIGS. 9 to 11. Further, the bottom recessed-portions 23 or the top recessed-portions 33 may be provided in larger numbers. In this way, the number of articles H that can be contained in one package 10 can be increased.

Further, the recessed top cover 30 of the package 10 in this embodiment may have a top recessed-portion 40 whose cross section has a stair shape.

This enables the package 10 to pack tuner main bodies 1 of different rectangular sizes, for example. Namely, when the tuner main body 1 is thin, a narrow-deep recessed portion 41 formed in the top recessed-portion 40 may be used to support the tuner main body 1 and its input antenna 3. On the other hand, when the tuner main body 1 is thick, a wide-shallow recessed portion 42 formed in the top recessed-portion 40 may be used to support the tuner main body 1 and its input antenna 3. That is, the package 10 can hold articles H of two different sizes.

Figure 12:
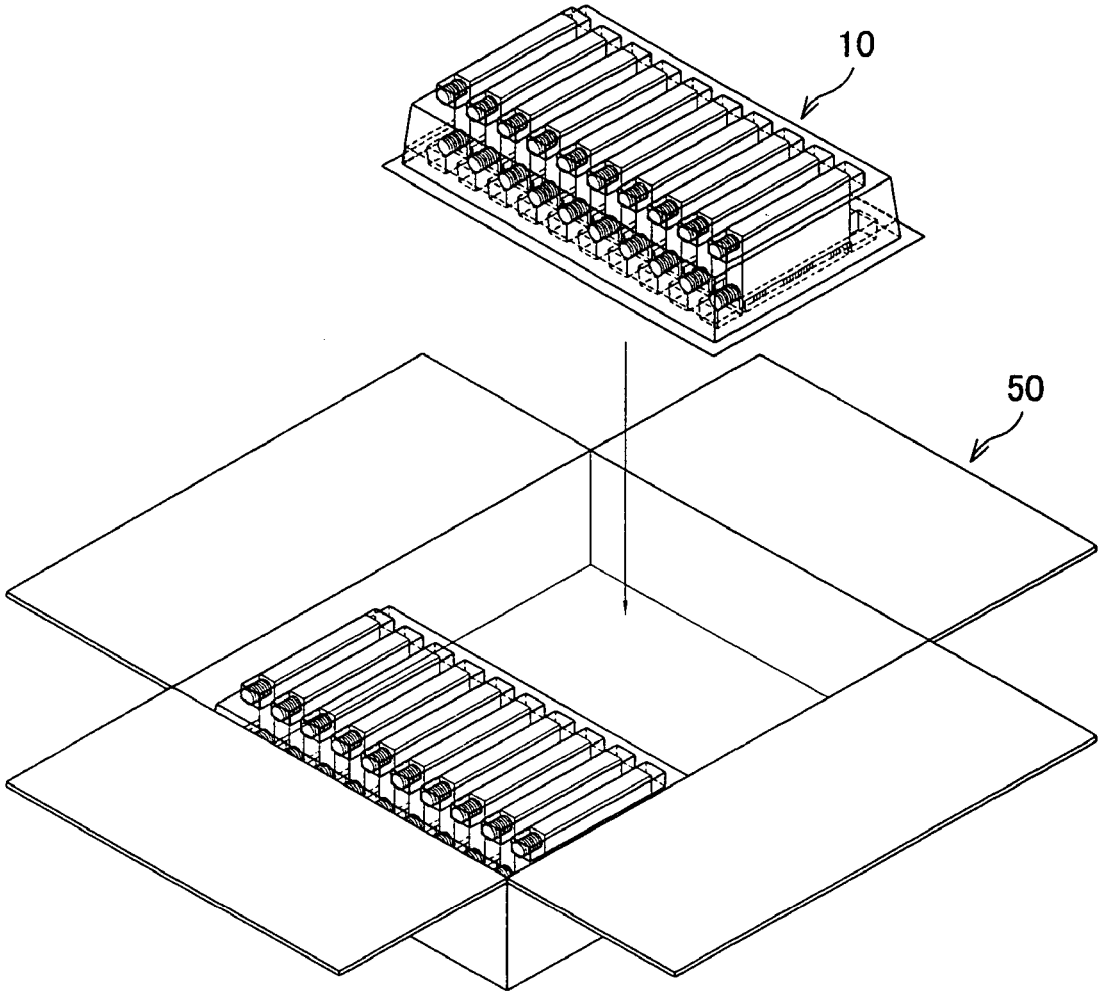
FIG. 12 is an exploded perspective view showing how the packages storing the articles are packed in a container.
Figure 13:
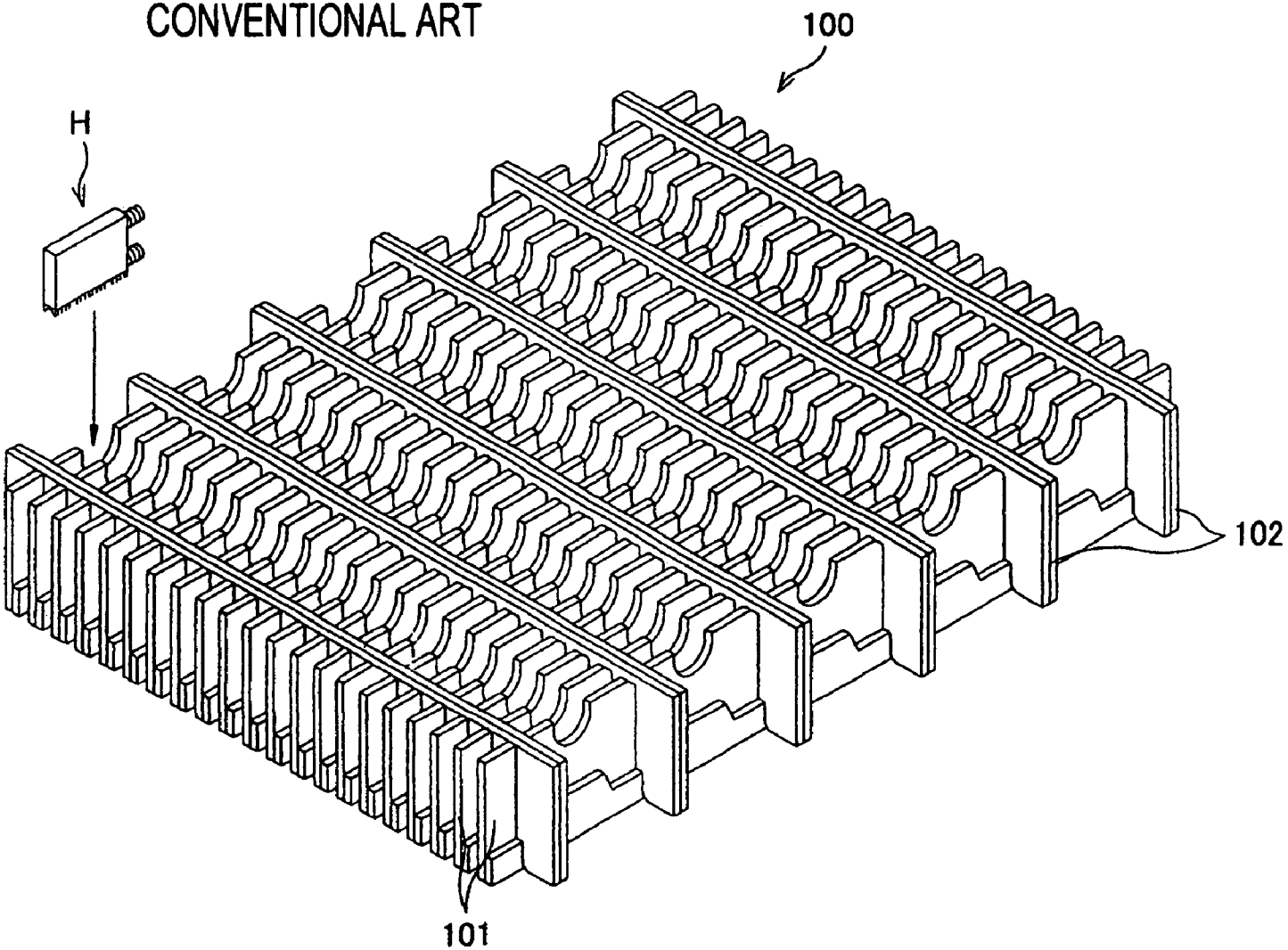
FIG. 13 CONVENTIONAL ART
FIG. 13 is a perspective view showing a partitioned package of conventional art.
Figure 14:
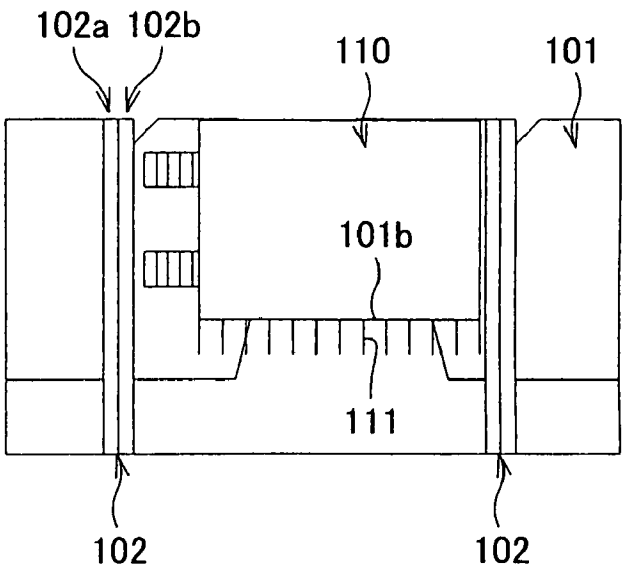
FIG. 14(*a*) is a front view showing how an article is stored in the partitioned package, and FIG. 14(*b*) is a front view showing the partitioned package storing the article.
Figure 14:
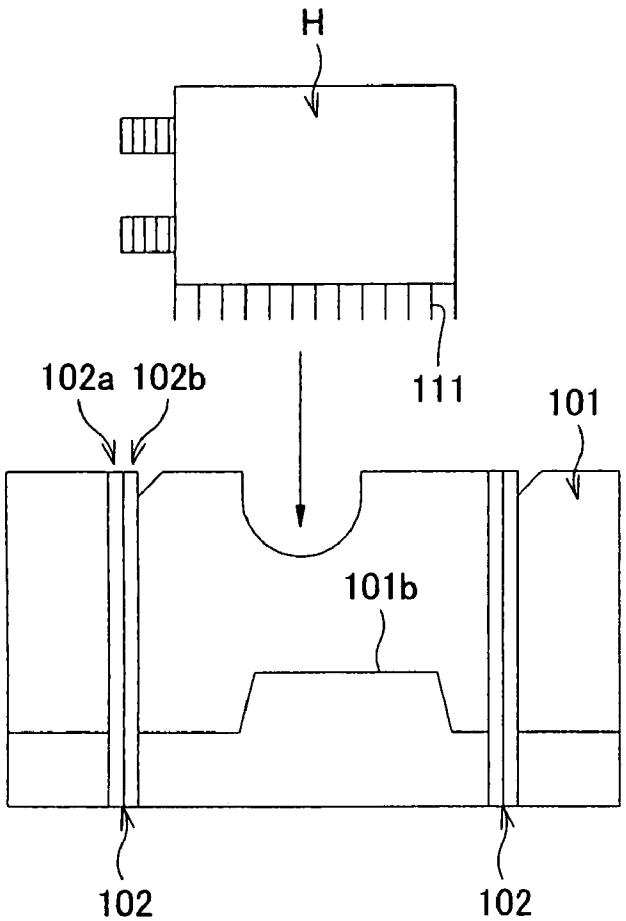
Figure 15:
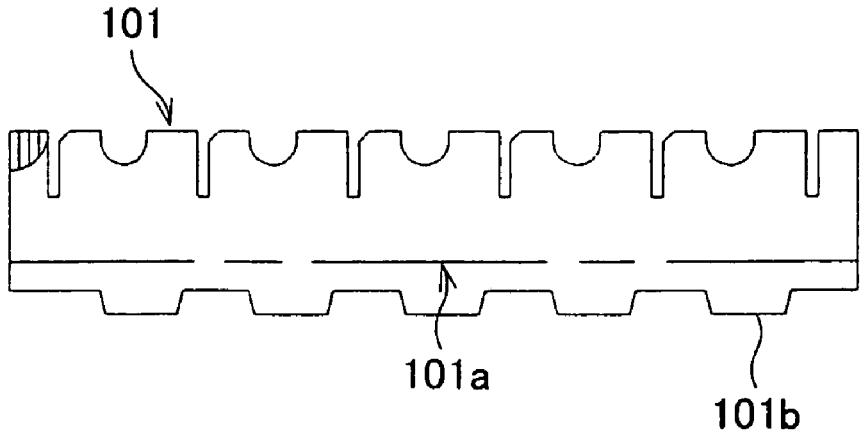
FIG. 15 is a developed view showing a configuration of a lateral partition of the partitioned package.
Figure 16:
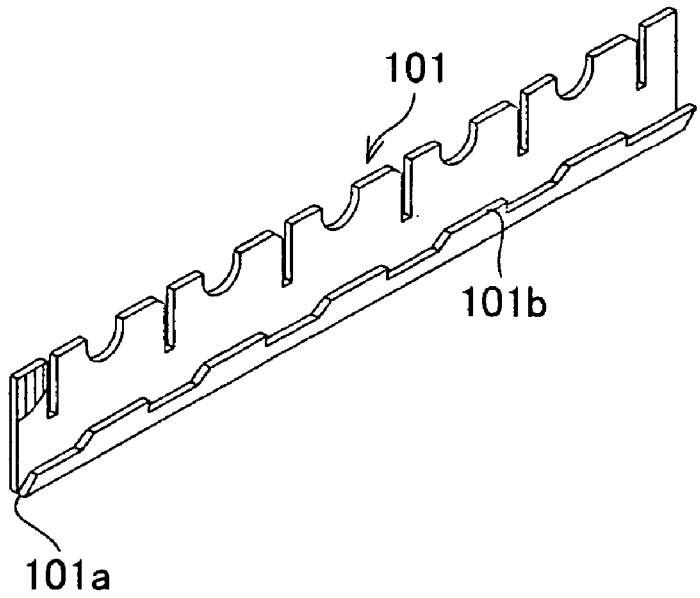
FIG. 16 is a perspective view showing how the lateral partition of the partitioned package is formed.
Figure 17:
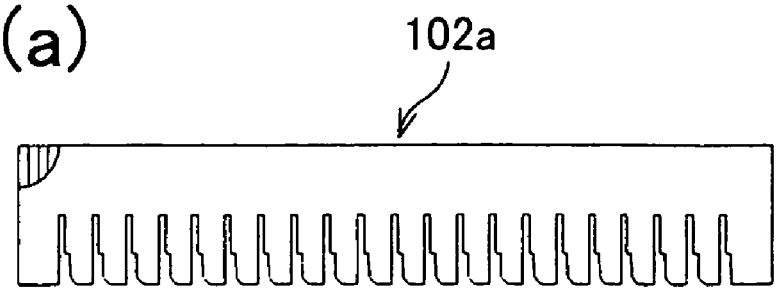
FIGS. 17(*a*) and 17(*b*) are developed views showing configuration of longitudinal partitions of the partitioned package.
Figure 17:
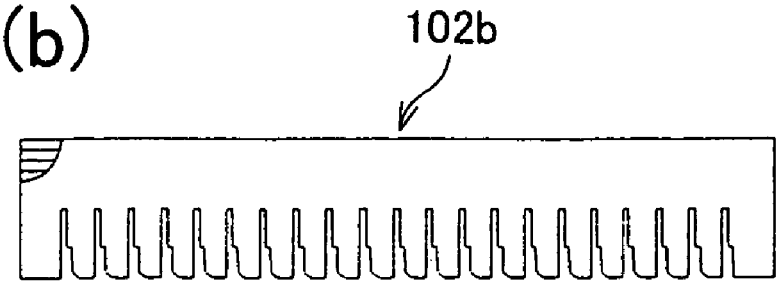
Figure 18:
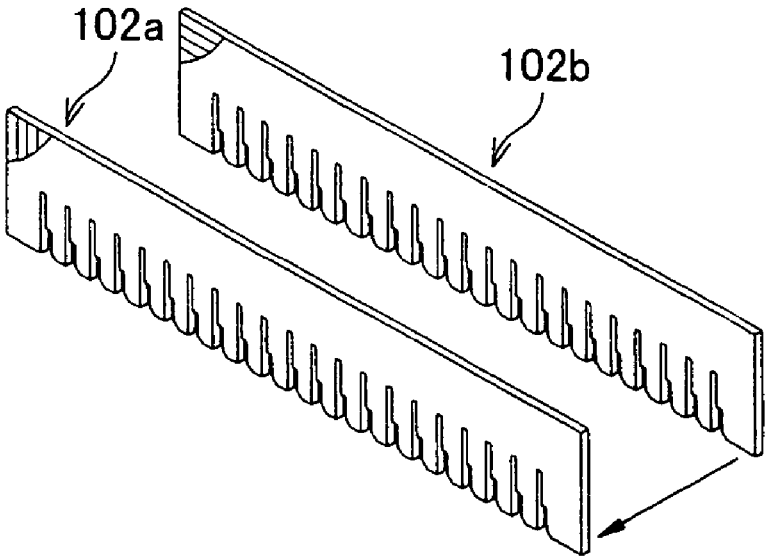
FIG. 18 is an exploded perspective view showing how the longitudinal partition of the partitioned package is made.
Figure 19:
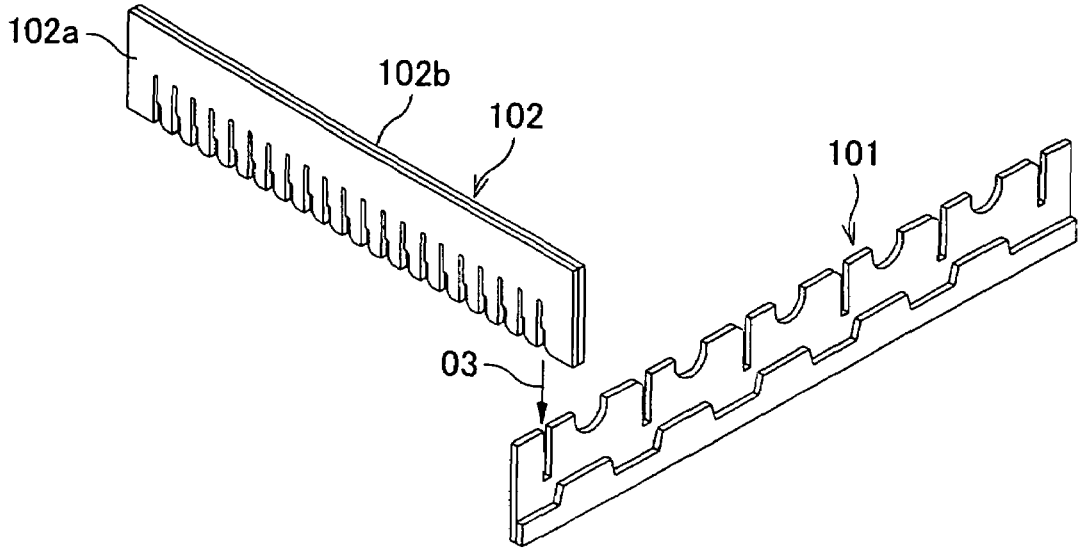
FIG. 19(*a*) is an exploded perspective view showing how the lateral partition and the longitudinal partition of the partitioned package are assembled, and FIG. 19(*b*) is a perspective view showing an assembly of the lateral partition and the longitudinal partition of the partitioned package.
Figure 19:
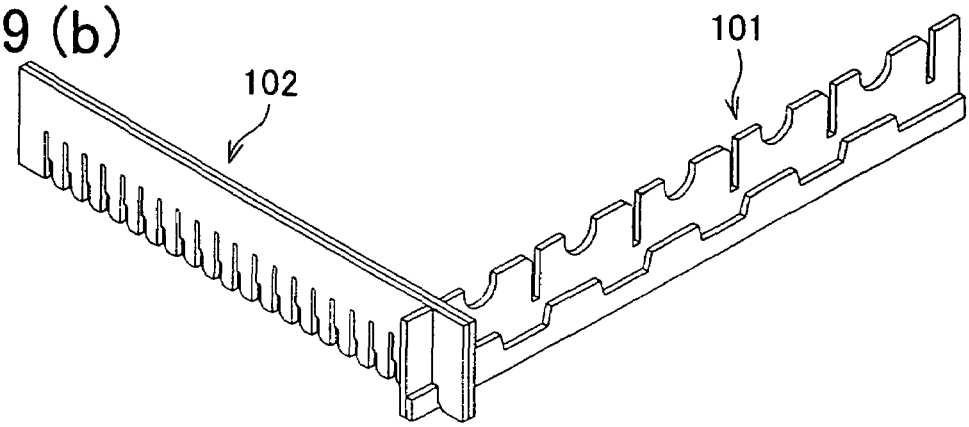
Figure 20:
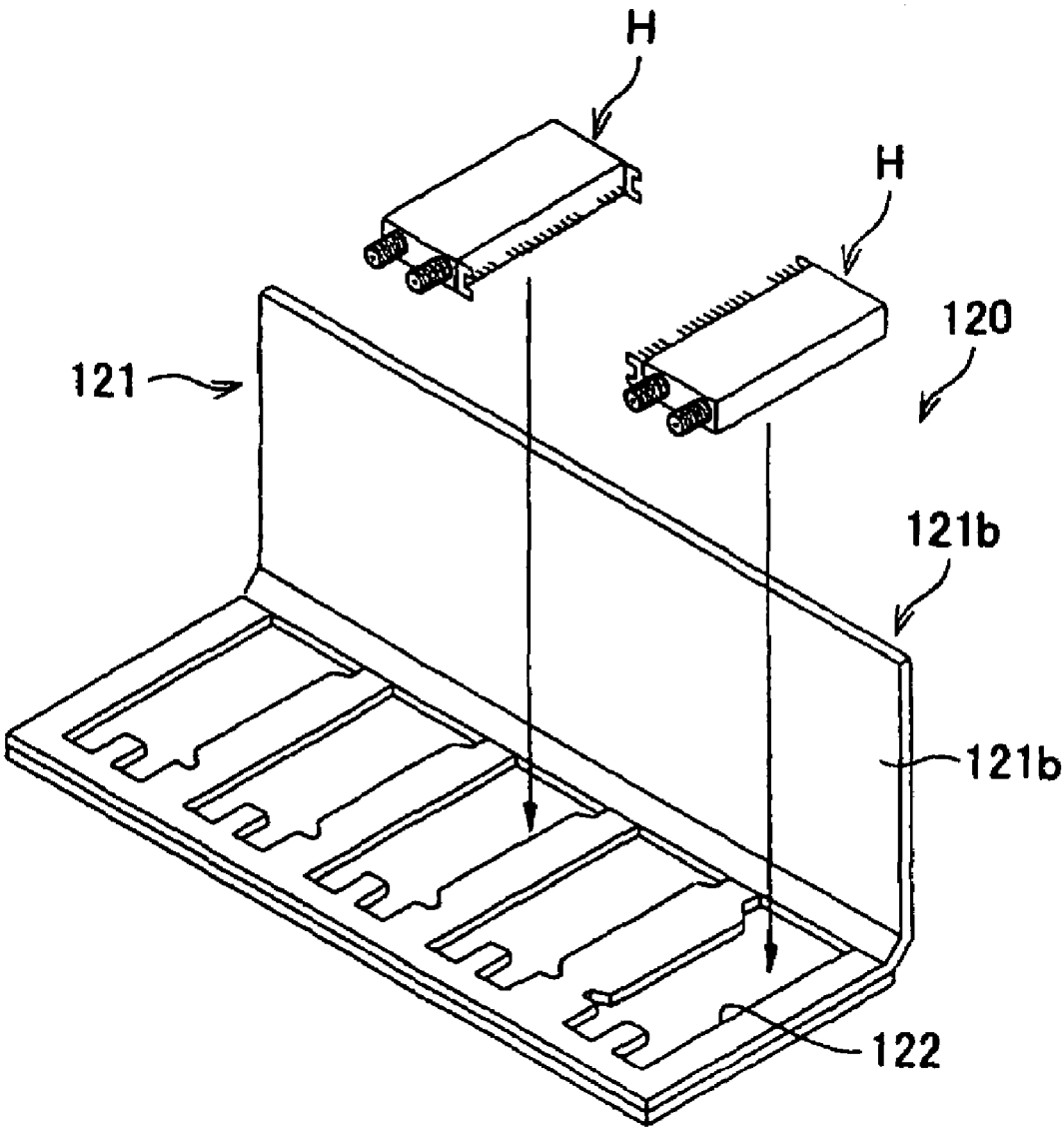
FIG. 20 CONVENTIONAL ART
FIG. 20 is a perspective view a book-type package of another conventional art.
Figure 21:
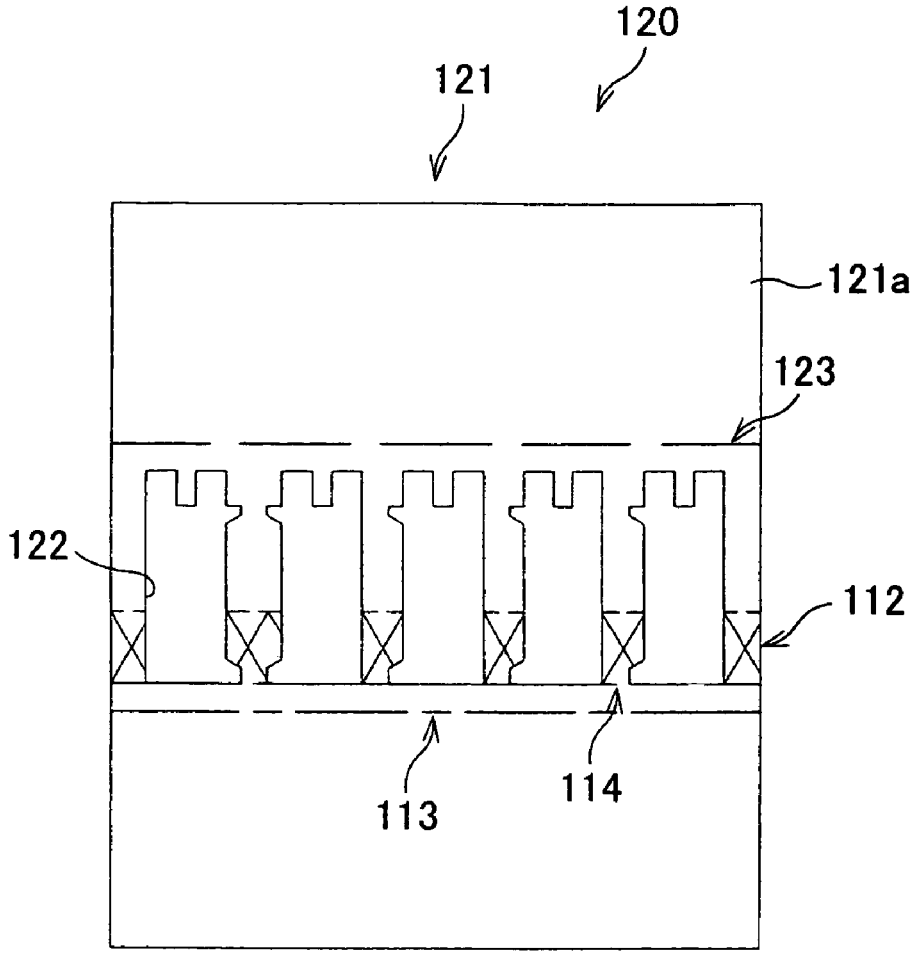
FIG. 21 is a developed view showing a configuration of the book-type package.
Figure 22:
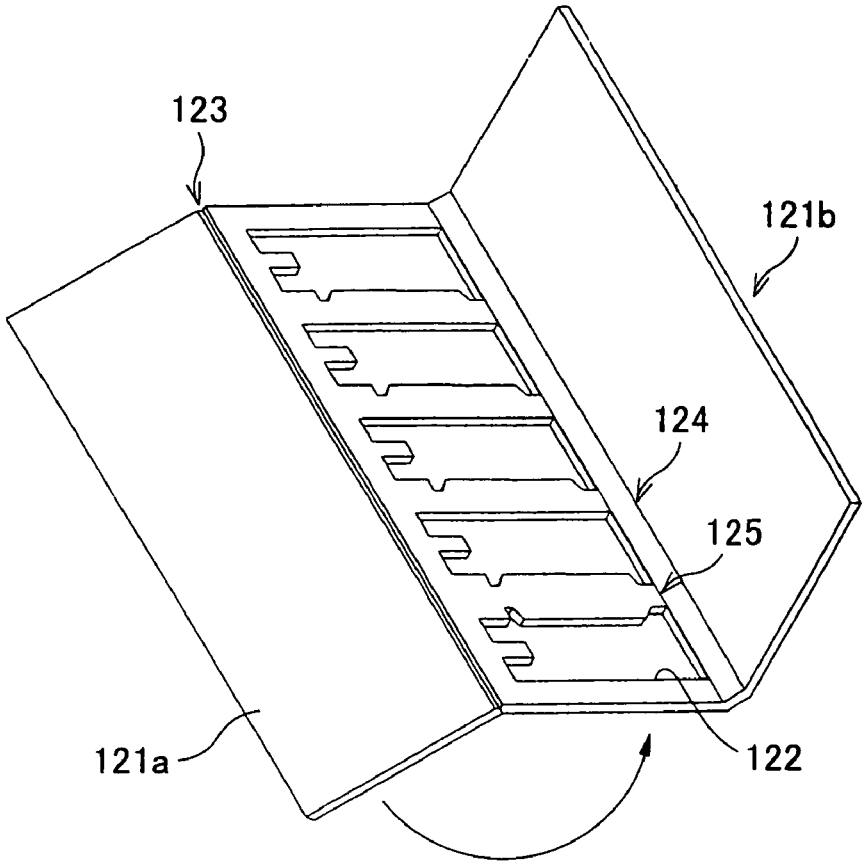
FIG. 22 is a perspective view showing how the book-type package is made.
Figure 23:
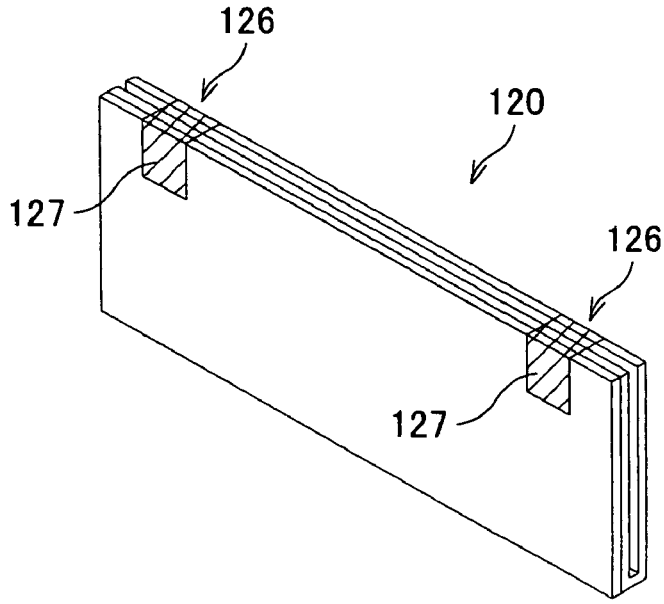
FIG. 23 is a perspective view showing a packed state of the book-type package.
Figure 24:
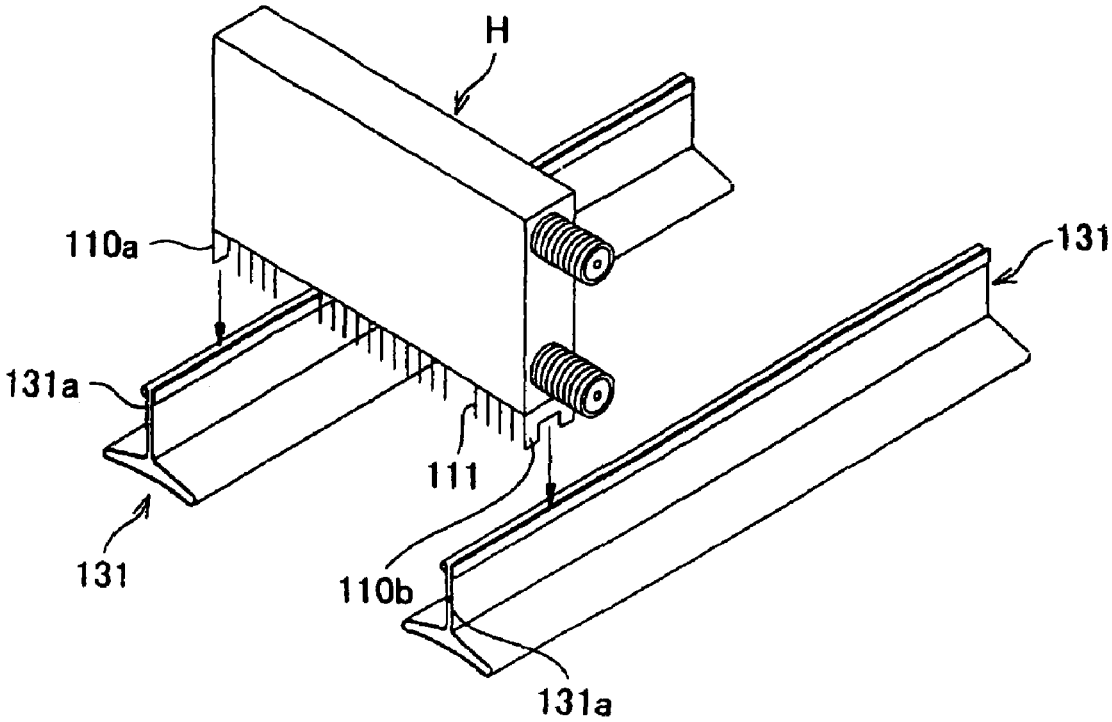
FIG. 24 CONVENTIONAL ART
FIG. 24 is a perspective view showing frames of a frame-type package of yet another conventional art.
Figure 25:
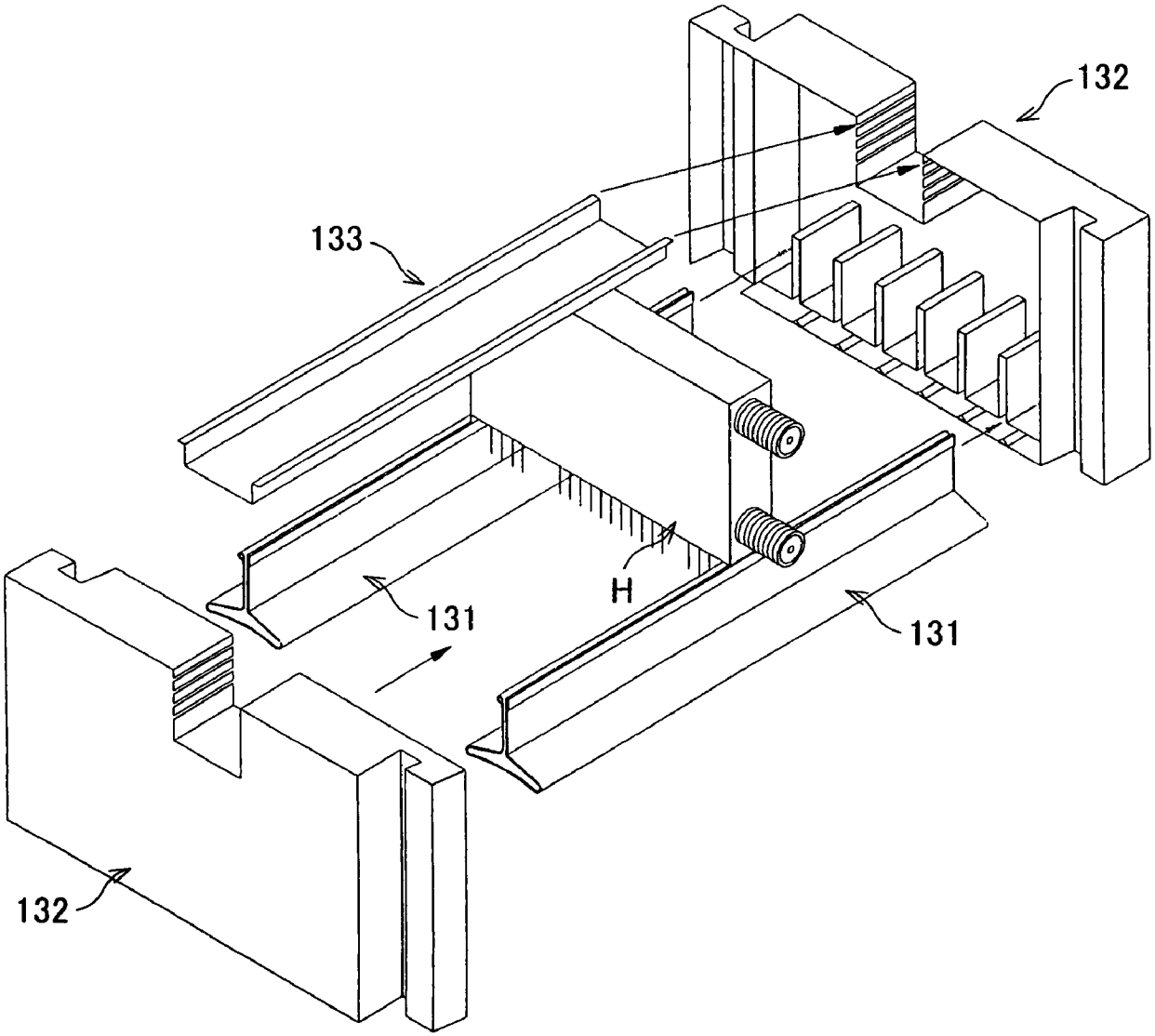
FIG. 25 is an exploded perspective view showing how packing is made in the frame-type package.
Figure 26:
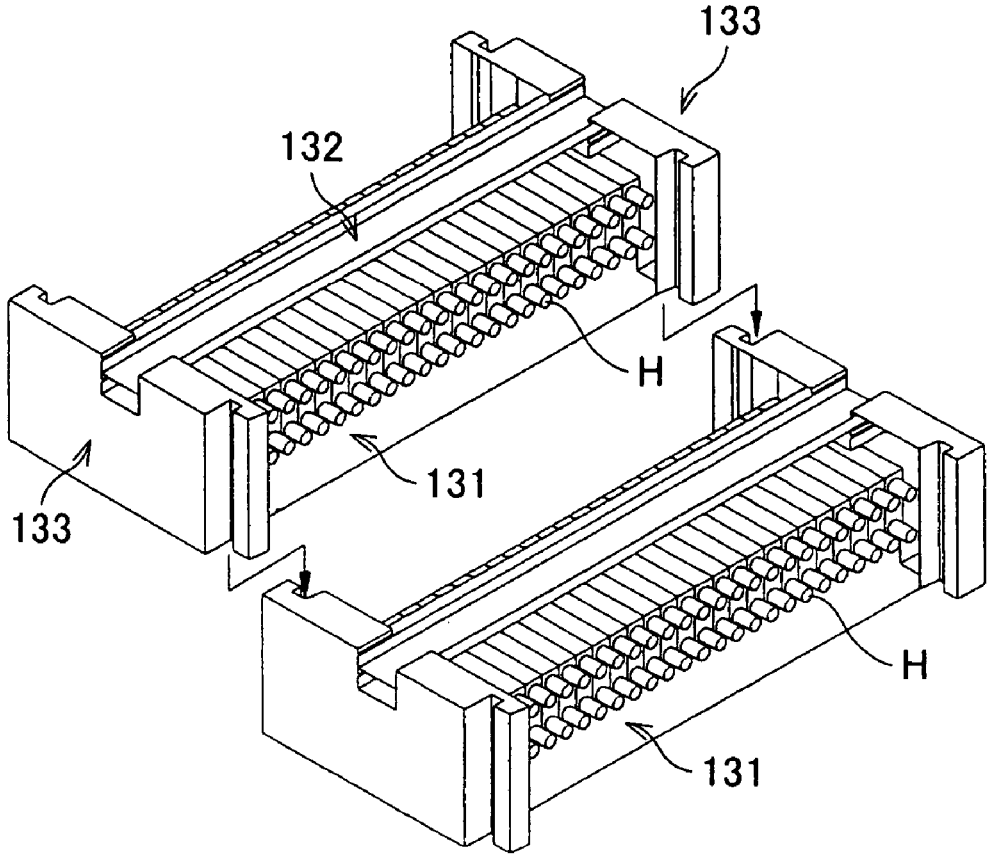
FIG. 26 is an exploded perspective view showing how units of frame-type package are combined during packing.
Figure 27:
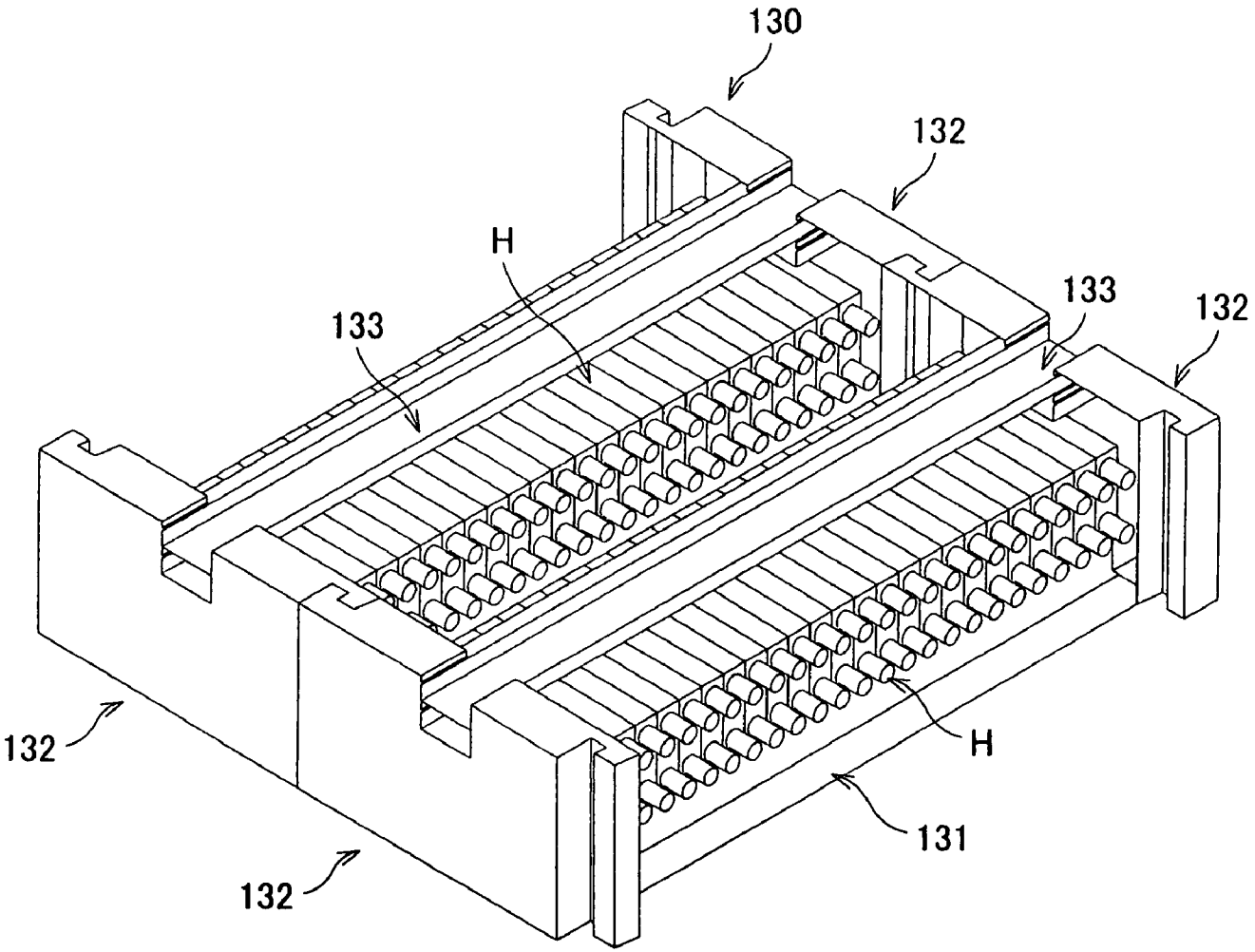
FIG. 27 is a perspective view showing a packed state of the frame-type package.

A plurality of articles H so packed in the package 10 are shipped in a container 50 which serves as a shock absorber, as shown in FIG. 12.

It should be noted that the number of the retainer sections 24, and the number of the chassis pins 5 on the article H are respectively two in this embodiment, however the numbers are not limited to such arrangement, and the number of the retainer sections 24 and the number of the chassis pins 5 may respectively be one, or more than three.

Further, each of the retainer sections 24 has a single pedestal section 24*a*, however the number of the pedestal section 24*a* is not limited to such arrangement, and each of the retainer section 24 may have a plurality of the pedestal sections.

Further, in the package 10, a plurality of the bottom recessed-portions 23 are provided in the recessed bottom tray 20, and a plurality of top recessed-portions 33 are provided in the recessed top cover 30, however the arrangement of the package 10 is not limited to such arrangement, and the package 10 may have a single bottom recessed-portion 23 and a single top recessed-portion 33.

As described, a package 10 according to this embodiment includes a recessed bottom tray 20 having a bottom recessed-portion 23 which conforms to a shape of a bottom portion of an article H;

a recessed top cover 30 having a top recessed-portion 33 which conforms to a shape of an upper portion of the article H; and a retainer section 24, formed in the bottom recessed-portion 23 of the recessed bottom tray 20, for retaining the chassis pins 5 formed on the article H, so as to prevent movement of the article H.

Further, a packing method according to this embodiment includes the step of supporting and anchoring an article H, using: a recessed bottom tray 20 having a bottom recessed-portion 23 which conforms to a shape of a bottom portion of the article H;

a recessed top cover 30 having a top recessed-portion 33 which conforms to a shape of an upper portion of the article H; and a retainer section 24, formed in the bottom recessed-portion 23 of the recessed bottom tray 20, for retaining the chassis pins 5 formed on the article H, so as to prevent movement of the article H.

The retainer section 24 of the package prevents lengthwise and downward movement of the articles H, and the bottom recessed-portion 23 of the recessed bottom tray 20 and the top recessed-portion 33 of the recessed top cover 30 prevents lateral and upward movement of the article H. This prevents the article H from moving in the direction of height, depth, or width, and there accordingly will be no falling of the article H. As for packing, it merely requires that the article be inserted into the bottom recessed-portion 23 by straddling the retainer sections 24 formed in the bottom recessed-portion 23, and that the recessed top cover 30 be placed from above.

Thus, there is provided a package and a packing method that allows for easy packing and that can prevent the articles from being damaged during transport or storage.

Additionally, in this embodiment, a package 10 includes a recessed bottom tray 20 having a plurality of bottom recessed-portions 23 which conform to a shape of a bottom portion of an article H;

a recessed top cover 30 having a plurality of top recessed-portions 33 which conform to a shape of an upper portion of the article H.

Therefore, in addition to the foregoing effects of the invention, the number of articles that can be packed in a single package can be increased.

Further, in the package 10 according to this embodiment, the retainer sections 24 have pedestal sections 24*a* on which the article H is placed.

This enables the article H to be stably mounted on the top portions 24*a* of the retainer sections 24.

Further, in the package according to this embodiment, the retainer section 24 is made of elastic material so as to retain the chassis pins 5 by the pressure the retainer sections exert on the chassis pins 5.

With the use of the elastic material, a force of lateral impact on the target H can be absorbed.

Further, in the package 10 of this embodiment, the retainer sections 24 are provided at two locations so as to respectively retain the chassis pins 5 formed at the both ends in the longitudinal direction of the article H. The pair of retaining sections 24, with its simple structure, prevent movement of the article H.

The distance between the chassis pins 5 varies depending on the size in the longitudinal direction of the article H. Even in this case, the same package can be used to pack articles of varying lengths when more than one pair of retainer sections 24 is provided and a suitable pair is selected according to the distance between the chassis pins 5.

Further, in the package 10 according to this embodiment, the retainer sections 24 are made of elastic plastic resin.

With the use of the plastic resin, a force of lateral impact on the article H can be absorbed. Moreover, the use of plastic resin for the retainer sections 24 allows the retainer sections 24 to be formed in one piece with the recessed bottom tray 20 when the same plastic resin is used as a material of the recessed bottom tray 20.

Further, in the package 10 according to this embodiment, the recessed bottom tray 20 and the recessed top cover 30 each have a single-piece construction made of elastic plastic resin.

With this configuration, a force of vertical impact on the target H can be absorbed. In addition, the recessed bottom tray 20 and the recessed top cover 30 can be produced with ease.

Further, the recessed top cover 30 of the package 10 in this embodiment may have a top recessed-portion 40 whose cross section has a stair shape.

This enables the package 10 to accommodate articles H of various thicknesses.

Further, in the package 10 of this embodiment, the recessed bottom tray 20 and the recessed top cover 30 are molded out of plastic.

This enables the recessed bottom tray 20 and the recessed top cover 30 to be produced with ease.

As described, the package of the present invention may be adapted so that the retainer section has a pedestal section on which an article is mounted.

Thus, the article can easily be mounted on the pedestal section of the retainer section.

Further, the package of the present invention may be adapted so that the retainer section is made of elastic, so as to stop the projection by the pressure the retainer section exerts on the projection.

With the elastic material, a force of lateral impact on the article can be absorbed.

Further, the package of the present invention may be adapted so that the projection is formed at two locations on the respective ends in the longitudinal direction of the article, and that the retainer section is formed in one or more pairs so as to retain the projections formed at two locations on the respective ends in the longitudinal direction of the article.

Movement of the article is thus prevented by the simple structure of the pair of retainer sections that are provided to respectively retain the two projections.

The distance between the projections varies depending on the size in the longitudinal direction of the article. Even in this case, the same package can be used to pack articles of varying lengths when more than one pair of retainer sections is provided and a suitable pair is selected according to the distance between the projections. Thus, packing costs can be reduced.

Further, the package of the present invention may be adapted so that the retainer section is made of elastic plastic resin.

With the use of the plastic resin, a force of lateral impact on the article can be absorbed. Moreover, the use of plastic resin for the retainer sections allows the retainer sections to be formed in one piece with the recessed bottom tray when the same plastic resin is used as a material of the recessed bottom tray.

Further, the package of the present invention may be adapted so that the recessed bottom tray and the recessed top cover each have a single-piece construction of elastic plastic resin.

With this construction, a force of vertical impact on the article can be absorbed. In addition, the recessed bottom tray and the recessed top cover can be produced with ease.

Further, the package of the present invention may be adapted so that the top recessed-portion of the recessed top cover has a cross section of a stair shape.

Therefore, the package can accommodate articles of various thicknesses.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A package comprising:

a recessed bottom tray having a bottom-recessed portion which conforms to a shape of a bottom portion of an article;

a recessed top cover having a top-recessed portion which conforms to a shape of an upper portion of the article; and first integrally formed retainer tabs projecting into the bottom-recessed portion of the recessed bottom tray, which retainer tabs are spaced to be inside projections formed on the article when the article is received in the recessed bottom tray so that the retainer tabs and the projections catch together, thereby preventing movement of the article.

2. The package as set forth in claim 1, wherein the first retainer tabs define a pedestal on which the article is placed.

3. The package as set forth in claim 1, wherein the first retainer tabs are made of elastic material so as to retain the projections by the pressure the retainer tabs exert on the projections.

4. The package as set forth in claim 1, wherein:

the projections are formed at two locations on respective ends in a longitudinal direction of the article.

5. The package as set forth in claim 1, wherein the retainer tabs are made of elastic plastic resin.

6. The package as set forth in claim 1, wherein the recessed bottom tray and the recessed top cover each have a single-piece construction made of elastic plastic resin.

7. The package as set forth in claim 1, wherein the top-recessed portion of the recessed top cover has a cross section of a stair shape.

8. The package as set forth in claim 1, wherein the projections formed on the article project from a bottom surface of the article and the retainer tabs protrude inward.

9. The package as set forth in claim 1, wherein the projections and the retainer tabs are configured to prevent a portion of the article between the projections formed on the article from contacting the package.

10. The package as set forth in claim 1, wherein the retainer tabs comprise a first retainer tab and a second retainer tab, the first retainer tab has a side face for contacting one of the projections formed on the article, the projections formed on the article so as to project downwards from the article, the second retainer tab has a second side face for contacting a second one of the projections formed on the article, the side face of the first retainer tab is formed on a side of the first retainer tab farthest from the second retainer tab, the side face of the second retainer tab is formed on a side of the second retainer tab farthest from the first retainer tab, the bottom-recessed portion includes a non-interference portion formed directly between the first retainer tab and the second retainer tab, the first retainer tab and the second retainer tab are adapted so as to receive on respective top surfaces thereof an underside of the article, the top surfaces being such that the article is supported above the non-interference portion and no part of the article contacts the bottom recessed portion between the first retainer tab and the second retainer tab.

11. The package as set forth in claim 1, wherein the article is a tuner and the projections are chassis pins, and an underside of the tuner is to be supported above the bottom-recessed portion by the retainer tabs such that terminal pins of the tuner do not contact the bottom-recessed portion.

12. A package comprising:

a recessed bottom tray having a plurality of bottom-recessed portions which conform to a shape of a bottom portion of an article;

a recessed top cover having a plurality of top-recessed portions which conform to a shape of an upper portion of the article; and first integrally formed retainer tabs projecting into each of the bottom recessed portions of the recessed bottom tray, which retainer tabs are spaced to be inside projections formed on the article when the article is received in the recessed bottom tray so that the retainer tabs and the projections catch together, thereby preventing movement of the article.

13. The package as set forth in claim 12, wherein the first retainer tabs define a pedestal on which the article is placed.

14. The package as set forth in claim 12 wherein the first retainer tabs are made of elastic material so as to retain the projections by the pressure the first retainer tabs exert on the projections.

15. The package as set forth in claim 12, wherein:

the projections are formed at two locations on respective ends in a longitudinal direction of the article.

16. The package as set forth in claim 12, wherein the retainer tabs are made of elastic plastic resin.

17. The package as set forth in claim 12, wherein the recessed bottom tray and the recessed top cover each have a single-piece construction made of elastic plastic resin.

18. The package as set forth in claim 12, wherein the top-recessed portions of the recessed top cover each have a cross section of a stair shape.

19. The package as set forth in claim 12, wherein the retainer tabs comprises a first retainer tab and a second retainer tab, the first retainer tab has a side face for contacting one of the projections formed on the article, the projections formed on the article so as to project downwards from the article, the second retainer tab has a second side face for contacting a second one of the projections formed on the article, the side face of the first retainer tab is formed on a side of the first retainer tab farthest from the second retainer tab, the side face of the second retainer tab is formed on a side of the second retainer tab farthest from the first retainer tab, each bottom-recessed portion includes a non-interference portion formed directly between the first retainer tab and the second retainer tab, the first retainer tab and the second retainer tab are adapted so as to receive on respective top surfaces thereof an underside of the article, the top surfaces being such that the article is supported above the non-interference portion and no part of the article contacts the bottom recessed portion between the first retainer tab and the second retainer tab.

20. The package as set forth in claim 12, wherein the article is a tuner and the projections are chassis pins, and an underside of the tuner is to be supported above one of the bottom-recessed portions by the first retainer tab such that terminal pins of the tuner do not contact the bottom-recessed portion.

21. A packing method comprising the steps of:

providing a recessed bottom tray having a bottom-recessed portion which conforms to a shape of a bottom portion of an article;

providing a recessed top cover having a top-recessed portion which conforms to a shape of an upper portion of the article;

providing integrally formed retainer tabs projecting into the bottom-recessed portion of the recessed bottom tray;

providing an article having spaced projections;

placing the article in the bottom-recessed portion of the recessed bottom tray with the retainer tabs between the projections so that the retainer tabs and projections catch together and prevent movement of the article; and placing the recessed top cover on the recessed bottom tray so that a portion of the article is received in the top-recessed portion.

22. A package comprising:

a bottom member comprising a side wall having a bottom edge for supporting the package and a top edge, said top edge bounding a bottom member top wall comprising a platform raised with respect to said bottom edge, said side wall and said top wall defining an under-platform volume open to ambient air, at least one recess formed in said top wall and projecting into said under-platform volume and conforming to the shape of a bottom portion of an article received in said at least one recess, and first and second spaced tab members projecting into said at least one recess for retaining the article; and a cover member comprising a side wall having a bottom edge and a top edge, said top edge bounding a top edge top wall comprising a platform raised with respect to said cover member side wall bottom edge, said cover member side wall and cover member top wall defining a cover interior and at least one hollow projection on said cover member top wall having an interior open to said cover interior, each said hollow projection interior conforming to the shape of a top portion of the article;

said bottom member top wall and at least a portion of said bottom member side wall being received in said cover member interior when said cover member is supported by said bottom member, and said bottom member recess being aligned with said top member recess.

23. The package of claim 22 wherein said bottom member side wall bottom edge includes an outwardly projecting flange parallel to said bottom member top wall and said cover member includes an outwardly projecting flange parallel to said cover member top wall, said cover member flange overlying said bottom member flange when said cover member is supported by said bottom member.

24. The package of claim 22 wherein said first and second tab members are hollow and flexible.

25. The package of claim 22 wherein said tab members are hollow and open to ambient air.

26. The package of claim 22 wherein said first and second tab members are received in said cover member interior when said cover member is supported by said bottom member.

27. A method of packing an article comprising:

providing a bottom member comprising a side wall having a bottom edge and a top edge, said top edge bounding a bottom member top wall comprising a platform raised with respect to said bottom edge, said side wall and said top wall defining an under-platform volume open to ambient air, at least one recess formed in said top wall and projecting into said under-platform volume and conforming to the shape of a bottom portion of an article received in said at least one recess, and first and second spaced, elastic, tab members projecting into said at least one recess;

providing an article having a bottom portion having first and second spaced projections and a top portion;

placing the bottom portion of the article into the at least one recess of the bottom member such that the spaced projections on the article engage the first and second tab members of the bottom member and bias the first tab member toward the second tab member;

providing a cover member comprising a side wall having a bottom edge and a top edge, said top edge bounding a top edge top wall comprising a platform raised with respect to said cover member side wall bottom edge, said cover member side wall and cover member top wall defining a cover interior and at least one hollow projection on said cover member top wall having an interior open to said cover interior; and placing the cover member onto the bottom member such that the top portion of the article is received within the interior of the cover member hollow projection and the bottom member top wall and a portion of the bottom member side wall are received in the cover interior.

28. A package holding at least one article, the at least one article comprising:

a rectangular prism shaped body having first and second parallel side walls and a top wall and a bottom wall connecting said first and second parallel side walls, first and second spaced first projections on said bottom wall and a plurality of second projections on said bottom wall between the first and second spaced first projections;

the package comprising:

a bottom member comprising a wall having at least one elongate slot, the at least one elongate slot having a bottom wall, first and second ends and first and second parallel side walls, the bottom wall including first and second spaced tab members extending into the at least one elongate slot, the at least one article being mounted in the at least one elongate slot such that the first and second parallel side walls frictionally engage the first and second side walls of at least one article and the first and second tab members contact the first and second first projections on the bottom wall to limit longitudinal movement of the at least one article in the at least one elongate slot; and a cover member having at least one elongate slot aligned with the at least one elongate slot on the bottom member when the cover member is mounted on the bottom member, the cover member at least one elongate slot having first and second parallel side walls frictionally engaging the first and second side walls of the article.

29. The package holding at least one article of claim 28 wherein said at least one article comprises a plurality of articles, said bottom member at least one elongate slot comprises a plurality of elongate slots and said cover member at least one elongate slot comprises a plurality of elongate slots.

30. The package holding at least one article of claim 28 wherein said plurality of second projections are spaced from the bottom wall of the bottom member at least one elongate slot.

31. A package for holding at least one article comprising:

a bottom member comprising a wall having at least one elongate slot, the at least one elongate slot having a bottom wall, first and second ends and first and second parallel side walls, the bottom wall including first and second spaced tab members extending into the at least one elongate slot; and a cover member having at least one elongate slot aligned with the at least one elongate slot on the bottom member when the cover member is mounted on the bottom member; wherein the bottom member wall and first and second tab members are received within the volume defined by the cover member when said cover member is mounted on said bottom member.

* * * * *